US008540349B2

(12) United States Patent
Lebens et al.

(10) Patent No.: US 8,540,349 B2
(45) Date of Patent: Sep. 24, 2013

(54) PRINTHEAD HAVING ISOLATED HEATER

(75) Inventors: John A. Lebens, Rush, NY (US); Christopher N. Delametter, Rochester, NY (US); David P. Trauernicht, Rochester, NY (US); Emmanuel K. Dokyi, Rochester, NY (US); Weibin Zhang, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 1157 days.

(21) Appl. No.: 12/143,880

(22) Filed: Jun. 23, 2008

(65) Prior Publication Data

US 2009/0315951 A1 Dec. 24, 2009

(51) Int. Cl.
*B41J 2/05* (2006.01)

(52) U.S. Cl.
USPC ..... 347/63; 347/56; 347/61; 347/62; 347/64

(58) Field of Classification Search
USPC ..... 347/56, 61, 62, 63, 64, 65
See application file for complete search history.

(56) References Cited

U.S. PATENT DOCUMENTS

| | | | | |
|---|---|---|---|---|
| 5,751,315 | A | 5/1998 | Burke et al. | |
| 5,851,412 | A | 12/1998 | Kubby | |
| 5,861,902 | A * | 1/1999 | Beerling | 347/63 |
| 6,164,759 | A * | 12/2000 | Fujii et al. | 347/54 |
| 6,273,555 | B1 | 8/2001 | Hess | |
| 6,340,223 | B1 * | 1/2002 | Hirata | 347/56 |
| 7,128,400 | B1 | 10/2006 | Silverbrook et al. | |
| 7,128,402 | B2 | 10/2006 | Silverbrook | |

FOREIGN PATENT DOCUMENTS

| | | | |
|---|---|---|---|
| EP | 1 066 966 | A2 | 1/2001 |
| JP | 07 227968 | A | 8/1995 |
| WO | WO 2004/048108 | | 6/2004 |

* cited by examiner

*Primary Examiner* — Charlie Peng
*Assistant Examiner* — Hung Lam
(74) *Attorney, Agent, or Firm* — William R. Zimmerli; Peyton C. Watkins

(57) ABSTRACT

A liquid ejector includes a substrate, a heating element, a dielectric material layer, and a chamber. The substrate includes a first surface. The heating element is located over the first surface of the substrate such that a cavity exists between the heating element and the first surface of the substrate. The dielectric material layer is located between the heating element and the cavity such that the cavity is laterally bounded by the dielectric material layer. The chamber, including a nozzle, is located over the heating element. The chamber is shaped to receive a liquid with the cavity being isolated from the liquid.

12 Claims, 19 Drawing Sheets

PRINTHEAD HAVING ISOLATED HEATER

FIELD OF THE INVENTION

The present invention relates generally to micro heaters and their formation and, more particularly, to micro heaters used in ink jet devices and other liquid drop ejectors.

BACKGROUND OF THE INVENTION

Drop-on-demand (DOD) liquid emission devices have been used as ink printing devices in ink jet printing systems for many years. Early devices were based on piezoelectric actuators. A currently popular form of ink jet printing, thermal ink jet (or "thermal bubble jet") devices use electrically resistive heaters to generate vapor bubbles which cause drop emission.

The printhead used in a thermal inkjet system includes a nozzle plate having an array of ink jet nozzles above ink chambers. At the bottom of an ink chamber opposite the corresponding nozzle is an electrically resistive heater.

In response to an electrical pulse of sufficient energy, the heater causes vaporization of the ink, generating a bubble that rapidly expands and ejects a drop.

There is a minimum threshold energy required to be applied to the heater in order to achieve bubble formation sufficient to reliably eject a drop. To eject a drop, the heater must supply sufficient heat to raise the ink at the heater-ink interface to a temperature above a critical bubble nucleation temperature, approximately 280 C for water-based inks. This minimum threshold energy depends on the volume of drop ejected and the printhead design such as the electrically resistive heater geometry.

Printhead designs of the prior art form the heater on an insulating thermal barrier layer, typically silicon dioxide, formed on the substrate. A protective passivation layer is formed over the electrically resistive heater for protection from the ink. When the heater is energized heat is transferred both to the ink and to the substrate. The heater in the prior art is inefficient because only about half of the energy generated by the heater goes into heating the ink. The rest flows into the substrate causing a temperature rise of the substrate. This temperature rise of the substrate is a disadvantage for high speed printing since if the substrate gets too hot, printing must be stopped to let the printhead cool down.

One mechanism for cooling the printhead is removal of heat by the ejecting drop. The amount of heat removed is proportional to the temperature and volume of the ejected drop. In fact for large drop volumes greater than 6 picoliters, printheads of the prior art can achieve a situation that for a 20-30 C temperature rise of the printhead, the energy required to eject a drop is equal to the heat energy removed by the ejected drop. In this case a steady state operating temperature can be achieved.

However, state of the art printers typically use drop sizes <3 pL. The efficiency of prior art heaters is too low for these lower volume drops to carry substantial heat energy away without the printer temperature becoming too hot. These small drops are also typically printed at a higher frequency exacerbating the problem.

Furthermore the size of the electrical drivers for the electrically resistive heaters is in part determined by the energy needed. The inefficiency of the electrically resistive heaters require larger drivers resulting in increased chip size. It is therefore desirable to increase the efficiency of the electrically resistive heater by minimizing the amount of heat that goes into the substrate.

One method to increase the efficiency of the electrically resistive heater is to provide a thermal barrier positioned between the substrate and the electrically resistive heater such as a cavity. Typically, the electrically resistive heater is formed at the end of wafer processing after the controlling circuitry has been formed. It is important therefore to design a process for forming a cavity that is compatible with low temperature backend processing.

After ejection of the ink drop it is also important that the heater cool down sufficiently so that when ink refills the chamber the temperature at the ink heater interface is insufficient to vaporize the refilling ink. Such vaporization would limit the operating frequency of the printhead. Note that while the timescale of the initial bubble vaporization is 1-2 μsec the ink refill takes place at a later time of 6-10 μsec. Therefore it is useful to provide a thermal path that can reduce the heater temperature sufficiently for this longer time cycle while at the same time not reducing the efficiency of the initial bubble formation. It is also important that this thermal path distribute the heat into the ink rather than into the substrate.

For printheads used in printing systems the energy applied to the electrically resistive heater in use is greater (typically 15-20%) than the threshold energy. This extra energy is used to account for resistance variations in the electrically resistive heaters and changes in threshold energy over the life of the heater. Because of the variations in heater resistances, this extra energy can cause variations in the drop ejection. It would therefore be useful to remove this excess heat rather than have it contribute to the vapor bubble formation.

It is also necessary for printheads to have a long lifetime. Any non-uniformities of the heater can cause poor nucleation of the vapor bubble as well as localized damage to the heater thereby reducing the lifetime of the printhead. It is therefore important that the heater surface be uniform in order to maintain the lifetime requirements of the printhead.

Damage to the heater also limits the lifetime of the printhead. Collapsing bubbles can create localized damage in the heater passivation layers. This localized damage in the passivation layers eventually reaches the heater layer, which causes a catastrophic failure of the heater. It is therefore important to limit this cavitation damage to a heater.

There is therefore a need for a printhead that has a long lifetime and provides high quality prints throughout its life. This printhead should also be capable of ejecting small drops at high frequencies with heater efficiencies adequate to prevent overheating of the printhead.

SUMMARY OF THE INVENTION

According to a feature of the present invention, a liquid ejector includes a substrate, a heating element, a dielectric material layer, and a chamber. The substrate includes a first surface. The heating element is located over the first surface of the substrate such that a cavity exists between the heating element and the first surface of the substrate. The dielectric material layer is located between the heating element and the cavity such that the cavity is laterally bounded by the dielectric material layer. The chamber, including a nozzle, is located over the heating element. The chamber is shaped to receive a liquid with the cavity being isolated from the liquid.

According to another feature of the present invention, a method of actuating a liquid ejector includes providing a liquid ejector including: a substrate including a first surface; a heating element located over the first surface of the substrate such that a cavity exists between the heating element and the first surface of the substrate; a dielectric material layer located between the heating element and the cavity such that the cavity is laterally bounded by the dielectric material layer; and a chamber including a nozzle located over the heating element, the chamber being shaped to receive a liquid, the cavity being isolated from the liquid; introducing liquid into the chamber of the liquid ejector; and causing the heating element and the dielectric material layer to deform into the cavity by forming a vapor bubble over the heating element.

According to another feature of the present invention, a method of forming a thermally isolated heating element for a liquid ejector includes providing a substrate including a first surface; depositing a sacrificial material layer over the first surface; patterning the sacrificial material layer; depositing a dielectric material layer over the patterned sacrificial material layer; forming a heating element over the dielectric material layer; and removing the patterned sacrificial material layer to create a cavity between the dielectric material layer and the first surface of the substrate.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
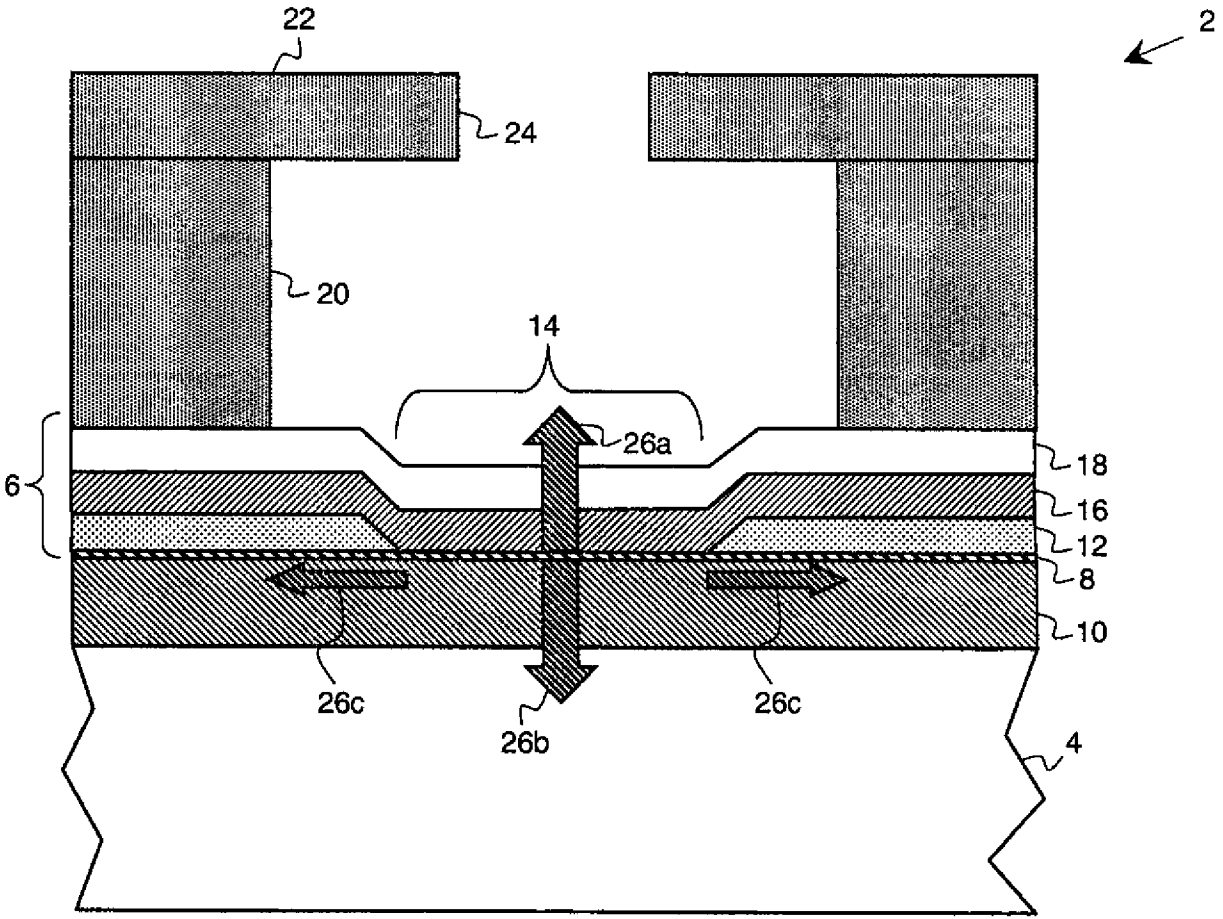
FIG. 1 (PRIOR ART)
FIG. 1 is a schematic cross sectional view of a prior art liquid ejector.

The present description will be directed in particular to elements forming part of, or cooperating more directly with, apparatus in accordance with the present invention. It is to be understood that elements not specifically shown or described may take various forms well known to those skilled in the art. In the following description, identical reference numerals have been used, where possible, to designate identical elements.

As described below, the present invention describes a micro heater that can be used in a liquid drop ejector, a method of actuating a liquid ejector, and a method of forming a micro heater stack for use in a liquid drop ejector. The most familiar of such devices are used as printheads in ink jet printing systems. Although the terms ink jet and liquid are used herein interchangeably, many other applications are emerging which make use of micro-heaters or heaters in systems, similar to inkjet printheads, which emit or eject other types of liquid in the form of drops. Examples of these applications include the delivery of polymers, conductive inks, and pharmaceutical drugs. These systems also have a need for the efficient heater stack of the present invention.

In current thermal inkjet printheads, the electrothermal heater includes a heater stack formed on the surface of a silicon chip containing control devices. FIG. 1 illustrates a cross-section of a single inkjet ejector 2 of the prior art with a heater stack 6 that is formed on a silicon substrate 4. On the substrate is a dielectric thermal barrier layer 10, typically 1-3 μm thick. This dielectric thermal barrier 10 is typically made from interlayer dielectrics formed when fabricating the electrical circuitry in other areas of the chip (not shown) that controls activation of the heater area 14 of the electrically resistive heater layer 8. An electrically conductive layer 12 is deposited on top of the electrically resistive heater layer 8 and is patterned and etched to form conductive traces that connect to the control circuitry (not shown) and also define the heater area 14.

Two layers are typically added to the heater stack 6 to increase heater lifetime by protecting it from the ink. An insulating passivation layer 16 is deposited. This insulating passivation layer 16 can be formed from silicon nitride, silicon oxide, silicon carbide, or any combination of these materials. On top of the insulating passivation layer 16 is deposited a protection layer 18. The protection layer 18 is typically formed with tantalum and protects the electrically resistive heater layer 8 from impact stresses resulting from bubble collapse.

Above the heater there is an ink chamber 20 with a nozzle plate 22 forming the roof of the chamber. Located above the heater a nozzle 24 is formed in the nozzle plate 22. Not shown is the ink feed for the chamber.

To eject a drop an electrical pulse, typically <1 μsec, is applied to the heater through the electrically conductive layer 12. Electrical energy applied to the heater produces thermal energy that is transferred to the ink at the ink-heater interface. At nucleation threshold a sufficient amount of heat energy is transferred to raise the temperature of the ink to cause vapor bubble formation. For water-based inks, the temperature for bubble nucleation is approximately 280 C. The arrows 26*a*, 26*b*, and 26*c* in FIG. 1 represent the heat flux due to the electrical pulse. Roughly equal amounts of heat flow to the ink in the ink chamber, represented by arrow 26*a* and to the substrate, represented by arrow 26*b*. A small fraction will diffuse laterally along the heater stack represented by arrows 26*c*. Only the heat flux represented by arrow 26*a* will contribute directly to bubble formation. The heat represented by arrows 26*b* and 26*c* is wasted and must be removed from the ejector, either by a heat sink or by transfer to the ink that is then ejected.

Figure 2:
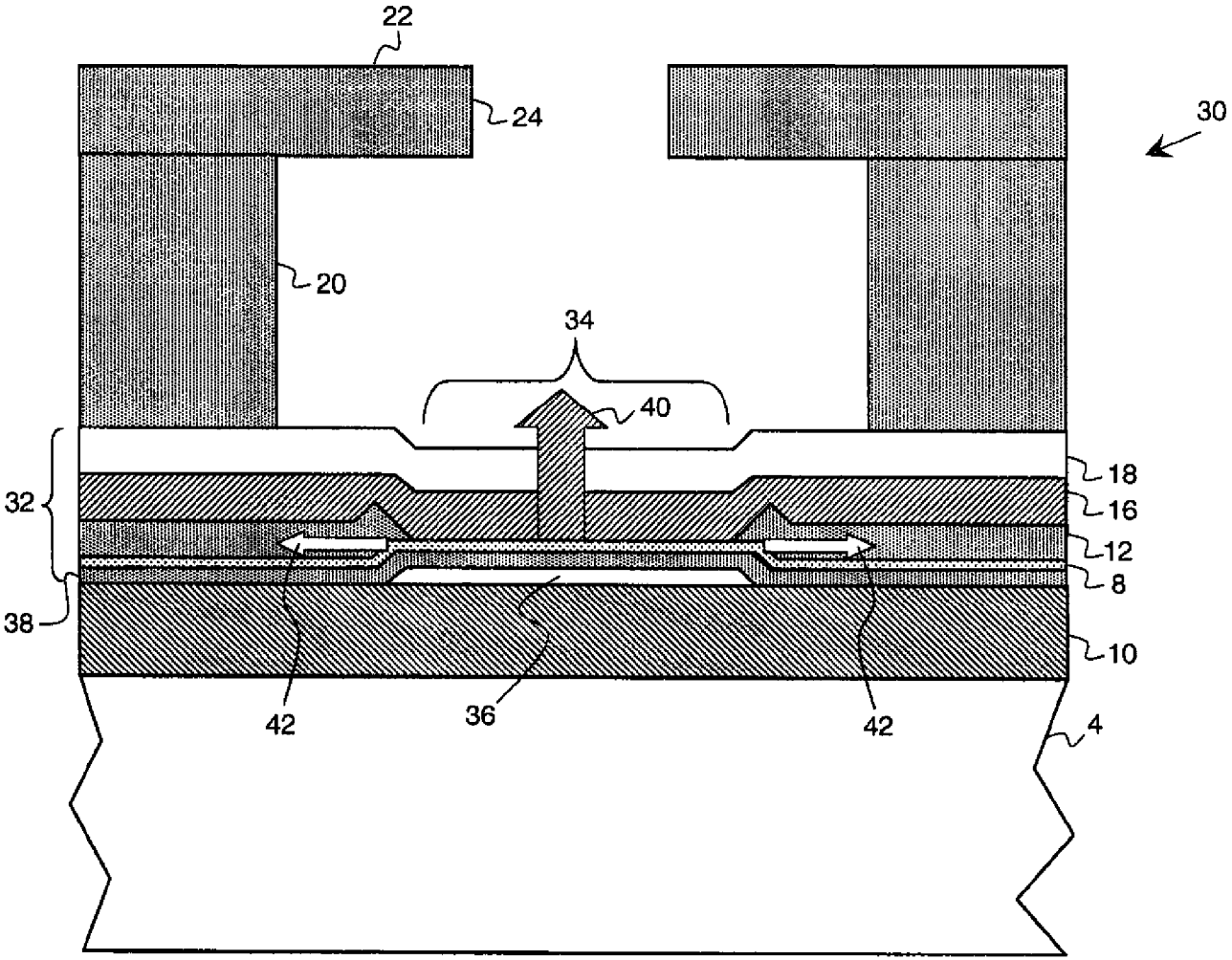
FIG. 2 is a schematic cross sectional view of a liquid ejector made in accordance with the present invention.

FIG. 2 shows a cross-section of an embodiment of a single inkjet ejector 30 with an isolated heater region 34 of the present invention. As in the prior art there is an oxide thermal barrier layer 10 deposited on the substrate 4 made from interlayer dielectrics, formed when fabricating the electrical circuitry in other areas of the chip. Formed in the isolated heater region 34 above the oxide thermal barrier layer 10 and below a lower dielectric protective layer 38 is an isolating cavity 36. The isolating cavity 36 is laterally bounded by dielectric protective layer 38. Isolating cavity 36 is sealed on all sides and contains a gas at a pressure less than atmospheric pressure. The lower dielectric protective layer 38 protects the heater layer from attack during the cavity formation process.

Similar to the configuration of the heater stack in the prior art, the isolated heater stack 32 of the present invention contains an electrically resistive heater layer 8, and an electrically conductive layer 12. Again two protective layers are formed on the isolated heater region; an insulating passivation layer 16, and a protection layer 18. In this case the thickness of these layers, when compared to the prior art, is reduced so as to increase the energy efficiency of the heater.

When the electrical pulse, typically <1 μsec, is applied to the electrically resistive heater layer 8 contained in the isolated heater stack 32 of the present invention the heat flux flows primarily into the ink in the ink chamber as represented by arrow 40. There is very little heat flux into the substrate due to the presence of the isolating cavity 36. As a result, the efficiency of heater stack 32 is increased when compared to the prior art.

There is still a lateral heat flux, represented by arrows 42, but, when compared to the prior arts the lateral heat flux is reduced due to heater stack 32 having a lower cross-sectional area which is at least partially created by the presence of isolating cavity 36.

FIGS. 3*a*-10 illustrates a fabrication method of the present invention for forming a printhead containing multiple single inkjet ejectors 30 with an isolating cavity formed in the isolating heater stack. The figures show a section of the printhead illustrating the process with two of the ejectors.

Figure 3A:
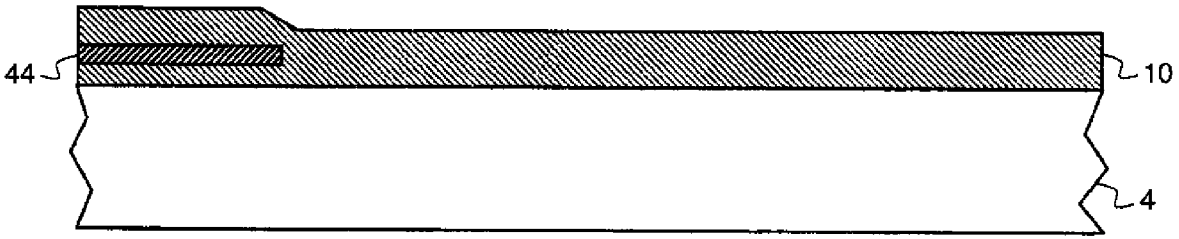
FIGS. 3*a*-10 show one method of forming an isolated heater in the liquid ejector of FIG. 2.
Figure 3B:
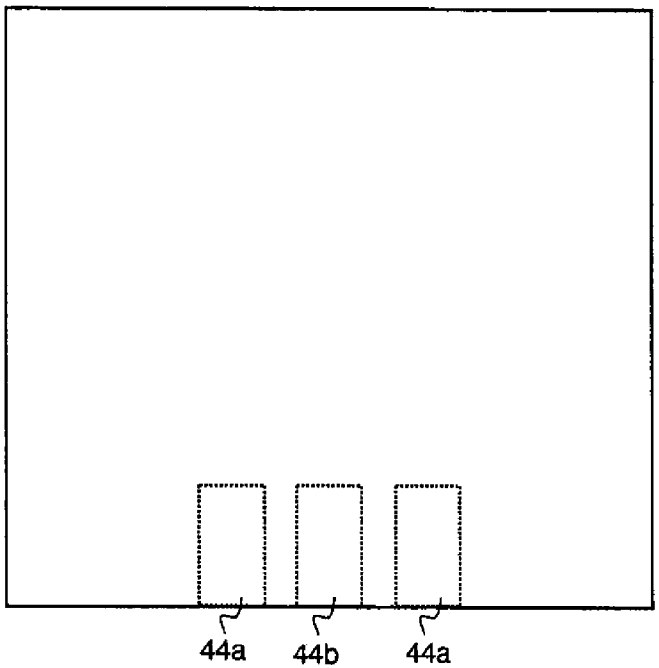

FIG. 3*a* shows, in cross-section along the heater length, a silicon substrate 4 on which has been fabricated electronic circuitry, for example, CMOS control circuitry and LDMOS drivers (not shown), the processing of which is well known in the art. This circuitry controls the firing of the heaters in an array of drop ejectors. The dielectric thermal barrier layer 10 is comprised of interlayer dielectric layers of the CMOS device. Contained within the interlayer dielectric layers are metal leads 44, which originate from one of the metal layers of the CMOS device circuitry and connect to the drive transistors (not shown). FIG. 3*b* shows a top down view with three metal leads 44; two leads 44*a* to drive the two ejectors and a shared common line 44*b*.

Figure 4A:
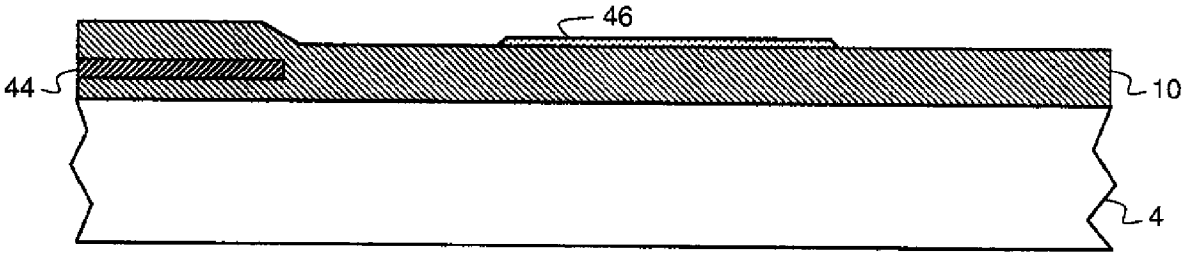
Figure 4B:
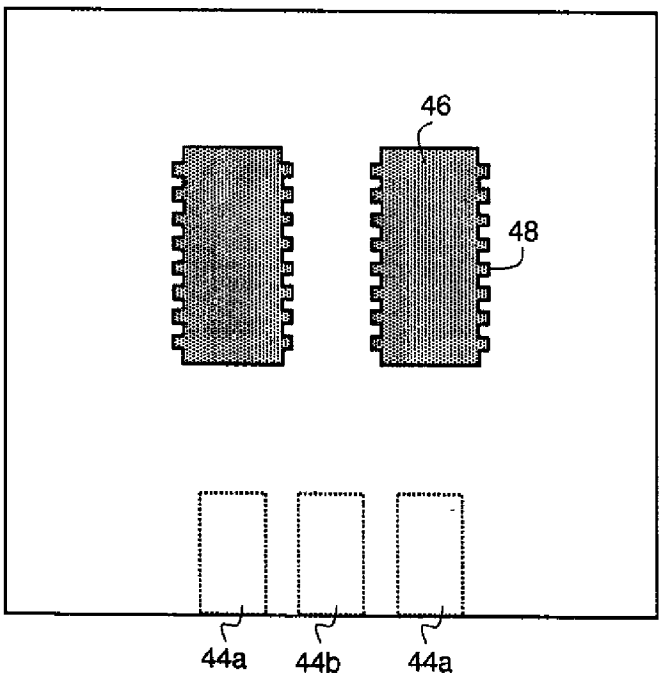

As shown in cross-section along the heater length in FIG. 4*a* and in top down view in FIG. 4*b*, a sacrificial layer 46 is deposited and patterned. In the preferred embodiment this layer is made from amorphous silicon deposited by physical vapor deposition. Other materials such as polyimide or aluminum can be used. The sacrificial layer 46 is deposited in a thickness range 100-2000 Angstroms. A thinner sacrificial layer results in shallower cavity thereby providing increased structural support for the suspended heater. Thinner sacrificial layers however are harder to remove and are more susceptible to stiction during both fabrication and operation. In the preferred embodiment the thickness is in the range 500-1000 Angstroms. FIG. 4*b* shows a top plan view of a printhead illustrating the process for two ejectors of an ejector array. The sacrificial layer 46 is rectangular in shape and contains small protrusions 48 positioned on each side.

Figure 5:
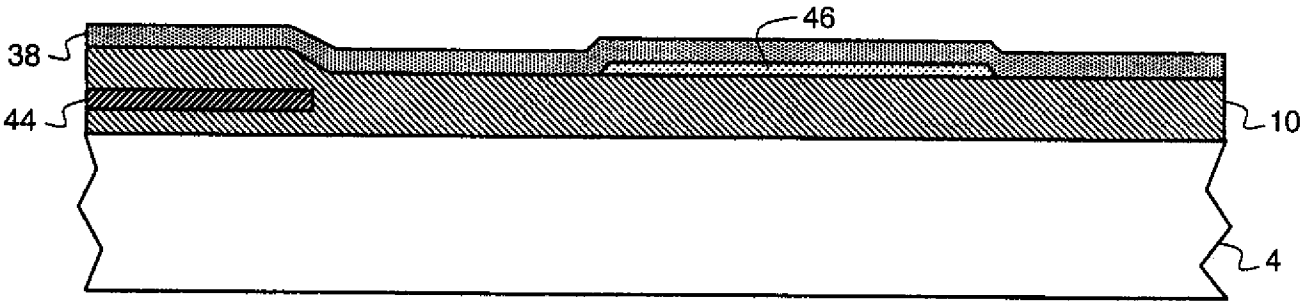

As shown in cross-section along the heater length in FIG. 5, a lower dielectric protective layer 38 is deposited. In the preferred embodiment this layer is made by plasma enhanced chemical vapor deposition (PECVD) of silicon nitride, silicon oxide, or a combination of the two materials. The lower dielectric protective layer is deposited in a thickness range 500-4000 Angstroms. A thinner layer requires less energy to heat and therefore is more thermally efficient but provides less mechanical support. In the preferred embodiment the thickness is in the range 500-2000 Angstroms.

Figure 6A:
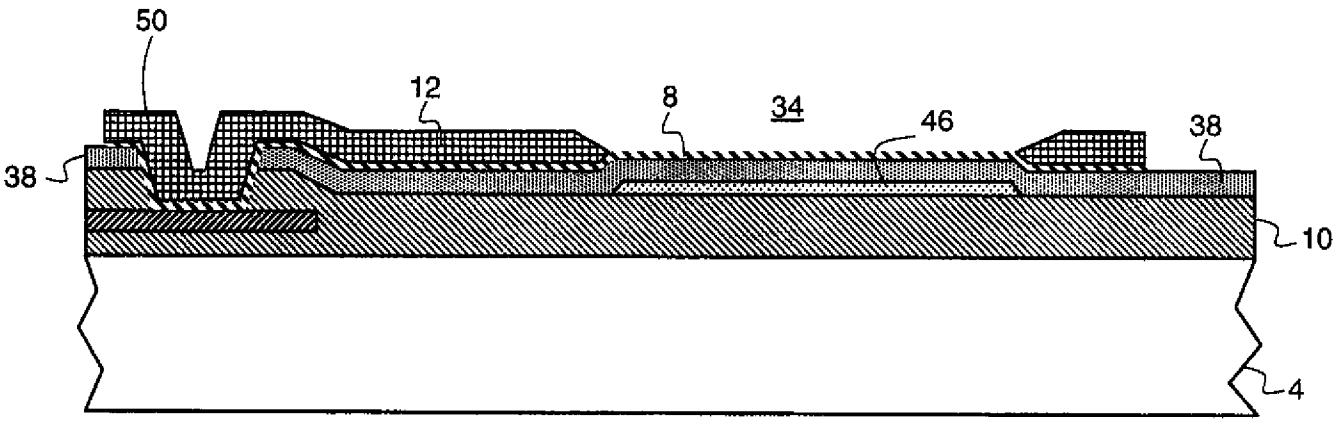
Figure 6B:
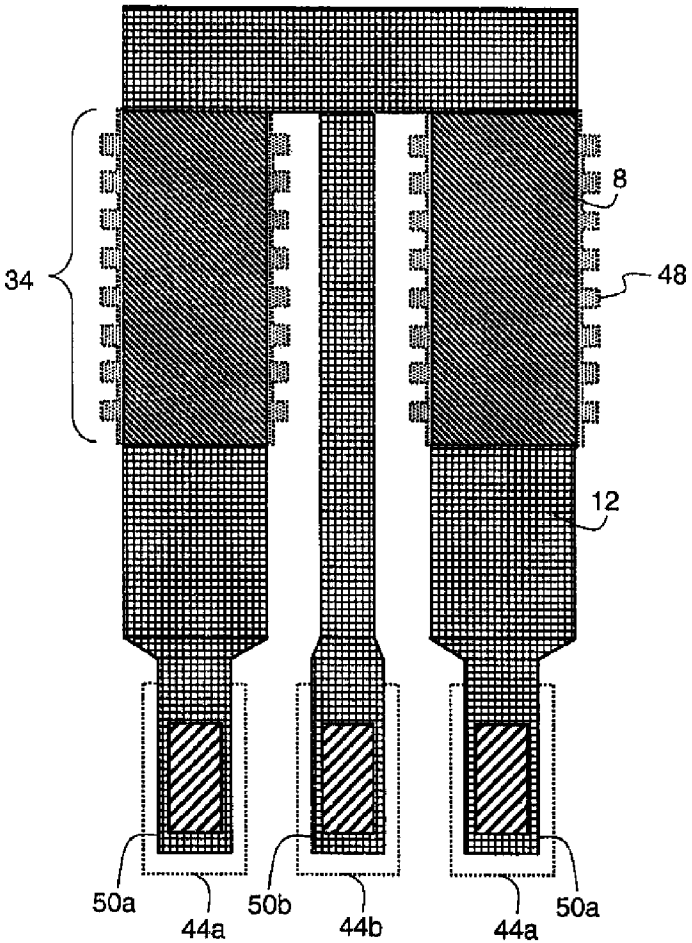

As shown in cross-section along the heater length in FIG. 6*a*, and in top down view in FIG. 6*b*, vias 50, 50*a*, 50*b* to the metal leads are etched followed by deposition and patterning of the electrically resistive heater layer 8 and electrically conductive layer 12 to form the heater region 34 which will subsequently become the isolated heater region of the present invention. The electrically resistive heater layer 8 is deposited in a thickness range 300-1000 Angstroms. The thinner the heater layer the less energy is needed to raise the heater temperature. However in practice the uniformity of very thin layers is difficult to control. In the preferred embodiment the thickness of heater layer 8 is in the range 400-600 Angstroms. The heater material is a ternary alloy containing tantalum, silicon, and nitride. Other ternary or quaternary alloys can be used. The electrically conductive layer 12 is deposited in a thickness range 2000-6000 Angstroms. In the preferred embodiment the material is aluminum or an aluminum alloy. As shown in FIGS. 6*a* and 6*b*, the electrically conductive layer does not extend over the region containing the sacrificial layer.

Figure 7A:
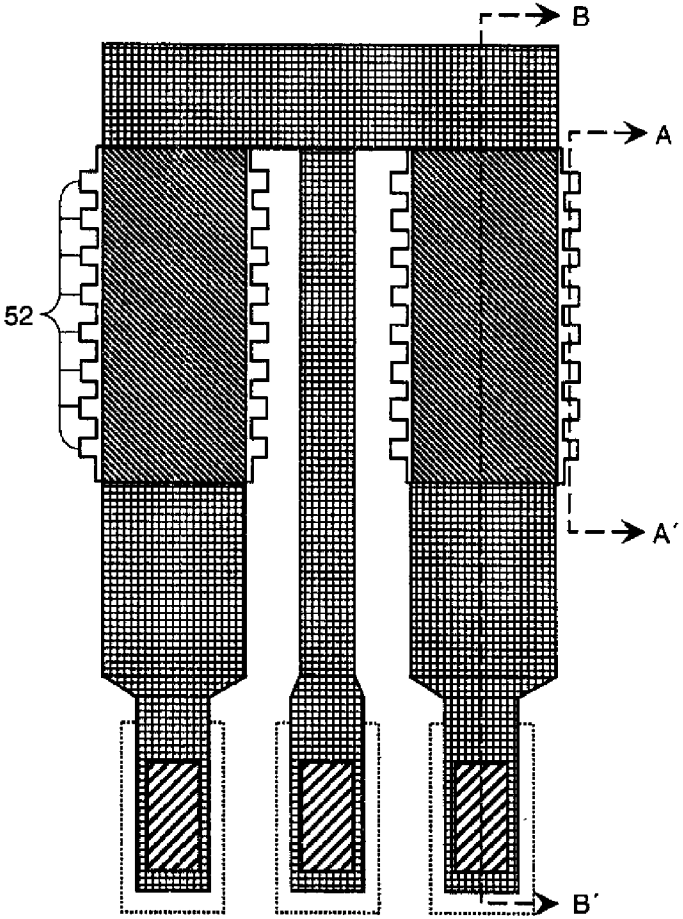
Figure 7B:
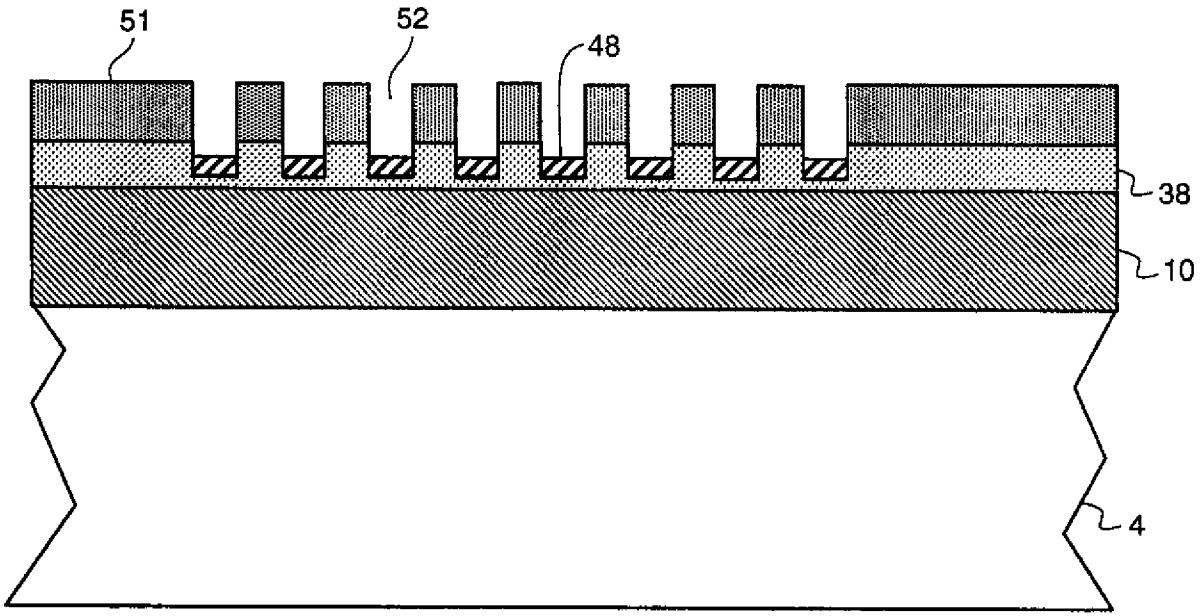

Referring to FIGS. 7*a* and 7*b*, a photoresist layer 51 is next coated and exposed to expose arrays of openings 52. FIG. 7*a* shows a top plan view of the photoresist openings 52. The size of the openings is in the range 0.8-2 μm. The use of small openings increases the strength of the suspended heater and also seals the isolating cavity better than larger openings. The photoresist openings are arranged to be aligned above the protrusions 48 of the sacrificial layer 46. A dry etch is used to remove the lower dielectric protective layer 38 below these openings 52 in order to expose the sacrificial layer 46 on the protrusions 48. In the preferred embodiment the dry etch is a plasma etch utilizing a sulfur hexafluoride gas. FIG. 7*b* shows a cross-section taken through line A-A' of FIG. 7*a* after the dry etch has removed the lower dielectric protective layer 38 and exposed the sacrificial layer 46.

Figure 8:
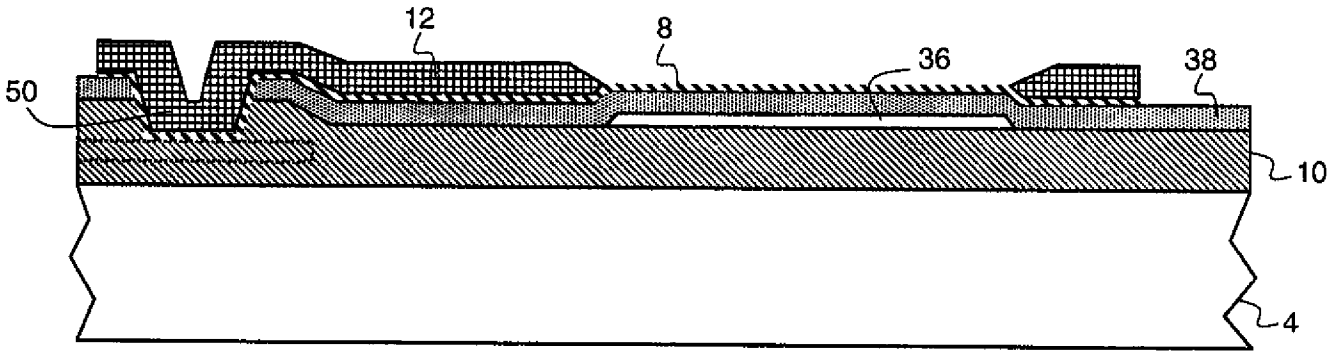

Referring to FIG. 8, the patterned substrate is next put into a chamber containing xenon difluoride gas. The xenon difluoride gas selectively removes the entire sacrificial layer 46, which is amorphous silicon in the preferred embodiment, to create an isolating cavity 36. The patterned photoresist layer 51 is left on to protect the electrically resistive heater layer 8 from attack by the xenon difluoride gas and then removed afterward. Alternatively a thin silicon nitride layer can be deposited on top of the electrically resistive layer 8 to protect it. In that case the photoresist layer can be removed prior to this step. This xenon difluoride gas etch removes the sacrificial material as shown in cross-section in FIG. 8 taken through line B-B' of FIG. 7*a*, shown after the photoresist layer 51 has been removed.

Figure 9A:
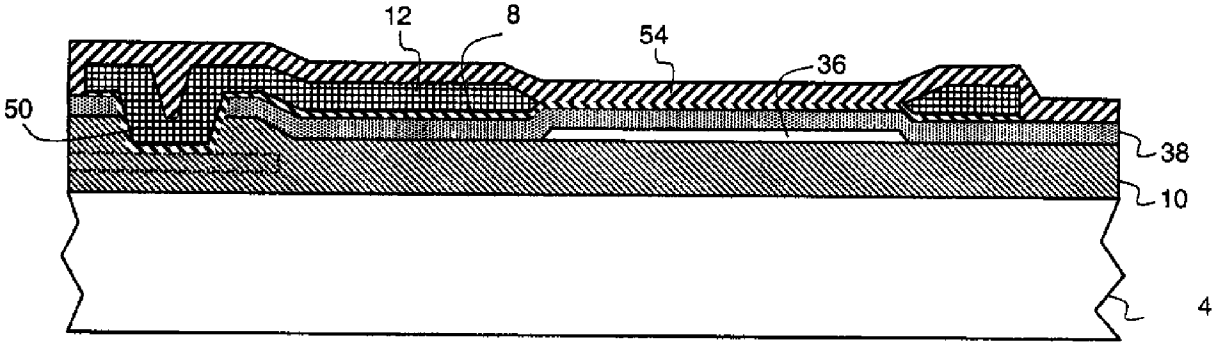
Figure 9B:
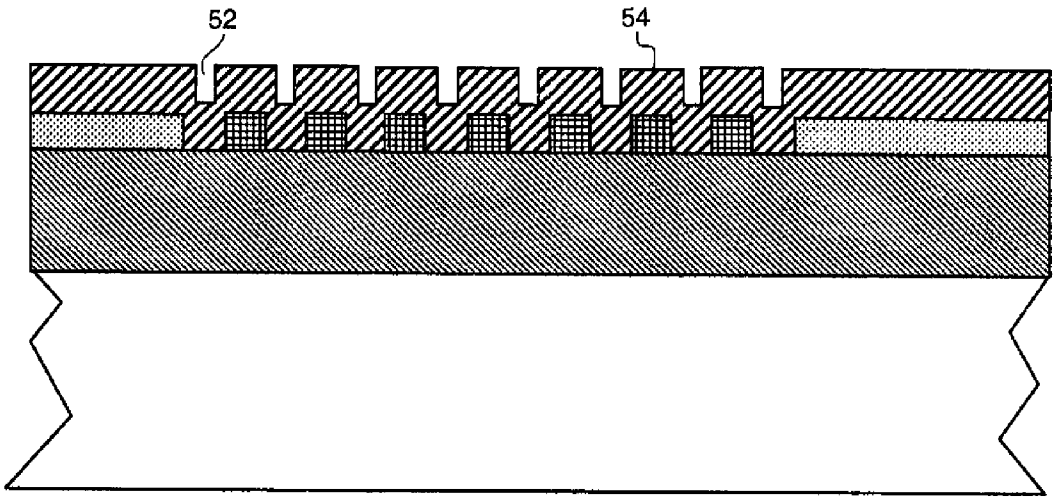

FIG. 9*a* shows a cross-section taken through line B-B' of FIG. 7*a* after an insulating sealing layer 54 has been deposited. This layer seals the isolating cavity 36 under the isolated heater region 34 of the present invention by filling up the openings 52. FIG. 9*b* shows a cross-section taken through line A-A' of FIG. 7*a* after the openings 52 have been sealed. The insulating sealing layer material is silicon nitride, silicon carbide, or a combination of the two materials. The deposition in the preferred embodiment is by plasma enhanced chemical vapor deposition (PECVD). The pressure in the sealed isolating cavity will be similar to the pressure used for the PECVD deposition and is typically <1 Torr. In the preferred embodiment the thickness of the insulating passivation layer is 1000-2500 Angstroms thick. The insulating sealing layer 54 also acts as the insulating passivation layer 16 and provides protection for the electrically resistive layer 8 from the ink.

Figure 10:
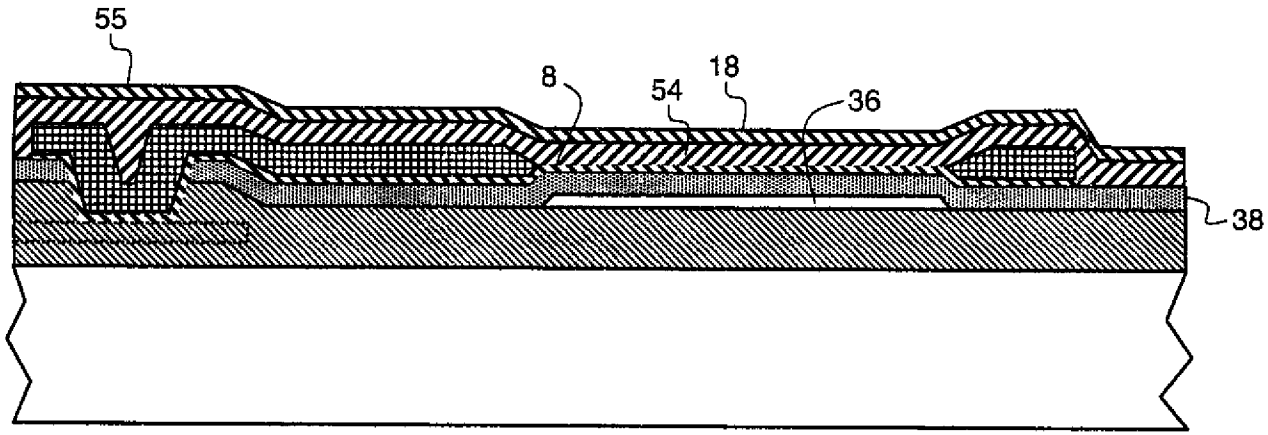

FIG. 10 is shows a cross-section after the deposition and patterning of a heat spreading layer 55. The heat spreading layer 55 is a good thermal conductor. In the preferred embodiment the heat spreading layer 55 is tantalum, deposited by physical vapor deposition, with a thickness of 500-2500 Angstroms. In this embodiment, the heat spreading layer 55 is a lateral extension of the protection layer 18 that protects the heater from the ink. The heat spreading layer 55 is left on throughout the ink chamber and acts as a heat transfer medium from the heater to the ink.

To use the device as an inkjet ejector, a chamber and nozzle plate can be fabricated as described in commonly assigned copending patent applications U.S. Ser. Nos. 11/609,375 and 11/609,365, both filed Dec. 12, 2006, the disclosures of which are incorporated by reference herein.

Figure 11B:
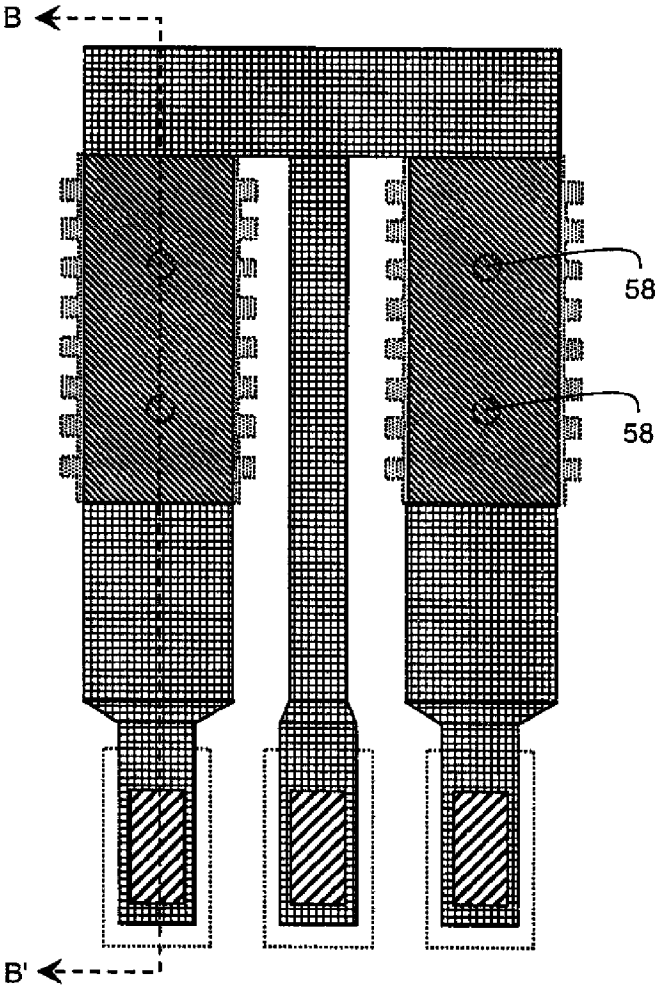
FIG. 11*b* is a schematic top view of two isolated heaters formed using the alternative method of patterning the sacrificial layer in FIG. 11*a*.
Figure 11A:
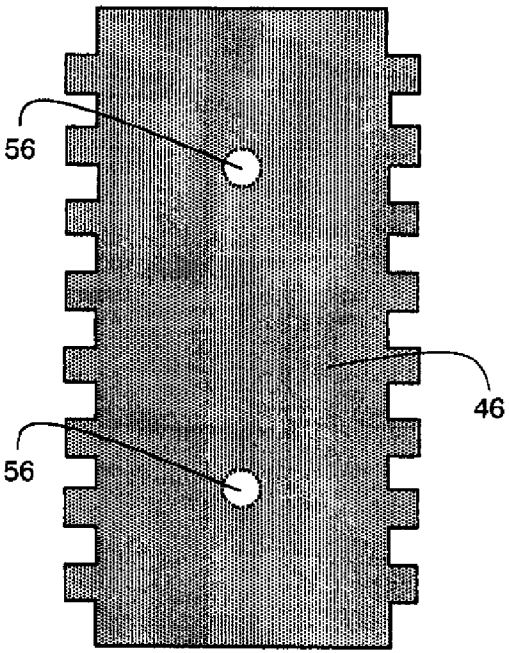
FIG. 11*a* is a schematic top view of an alternative method of patterning the sacrificial layer used in forming the isolated heater in the liquid ejector of FIG. 2.
Figure 11C:
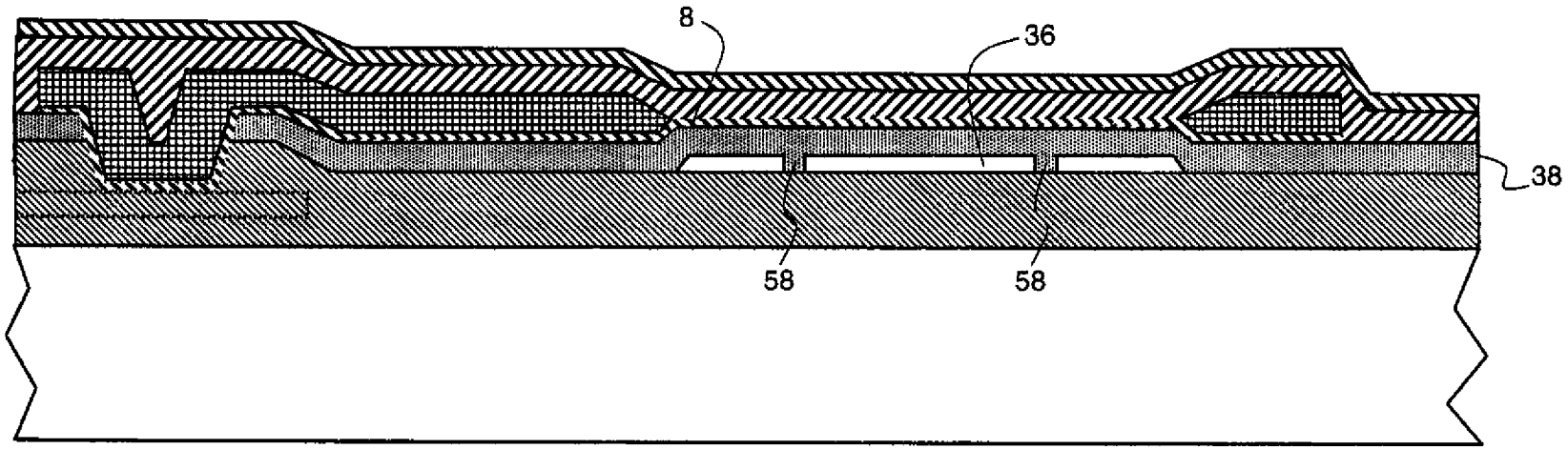
FIG. 11*c* is a schematic cross sectional view taken along line B-B' of FIG. 11*b*.

Referring to FIGS. 11*a*-11*c*, another embodiment is shown. FIG. 11*a* shows a top plan view of the patterned sacrificial layer 46 in which two holes 56 are formed in the sacrificial layer 46. The processing is then completed as described above with reference to FIGS. 3-10. FIG. 11*b* shows a top plan view of a heater of this embodiment. FIG. 11*c* shows a cross-section taken through line B-B of FIG. 11*b*. Two support posts 58 in the isolating cavity 36 have been formed in holes 56.

When the dielectric protective layer 38 is deposited over the sacrificial layer 46 (as in FIG. 5), the dielectric material (e.g. silicon nitride, silicon oxide, or a combination of the two materials) fills the holes 56. When the xenon difluoride gas removes the sacrificial layer 46, the material that is deposited into holes 56 is not removed. As a result, supports 58 provide mechanical support for heater layer 8 over isolating cavity 36. The diameter of the supports is in the range 0.4-1.0 μm with a preferred embodiment of 0.6-0.8 μm diameter. Two supports are shown in FIG. 11*c* although the number of supports 58 can vary, for example, between one and ten. The number, size, shape and position of the supports 58 is determined by the structural support requirements of the heater stack and is implemented through the mask design for patterning the sacrificial layer 46. The spacing between supports 58 can vary between one third and two thirds of the heater length.

Figure 12B:
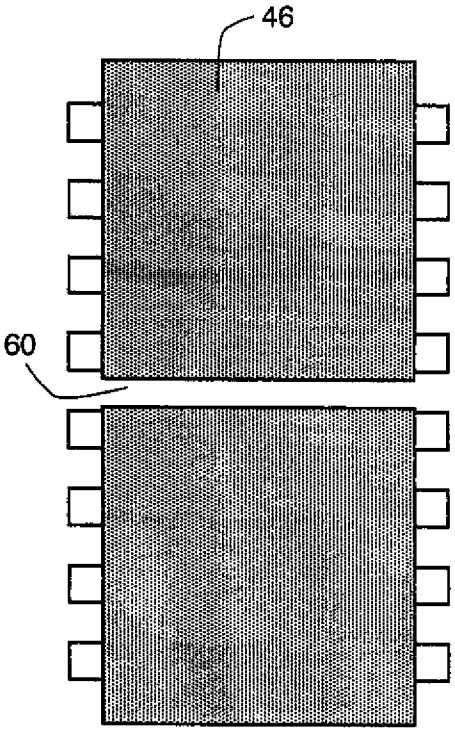
FIG. 12*b* is a schematic top view of another alternative method of patterning the sacrificial layer used in forming the isolated heater in the liquid ejector of FIG. 2.
Figure 12A:
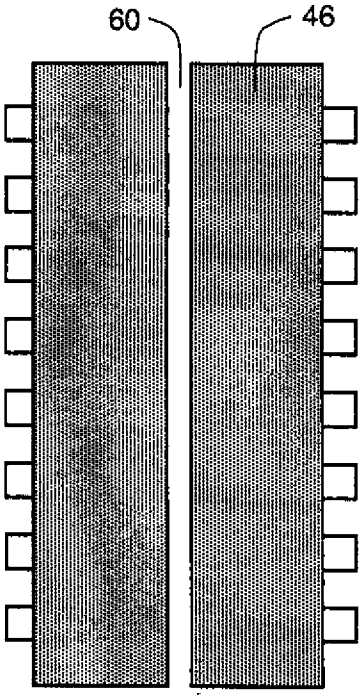
FIG. 12*a* is a schematic top view of another alternative method of patterning the sacrificial layer used in forming the isolated heater in the liquid ejector of FIG. 2.

Referring to FIGS. 12*a* and 12*b*, another embodiment is shown. FIG. 12*a* shows a top plan view of the patterned sacrificial layer 46 in which a strip 60 along the heater length is formed in the sacrificial layer. Alternatively FIG. 12*b* shows a top plan view of the patterned sacrificial layer 46 in which an opening, for example, a strip 60, perpendicular to the heater length is formed in the sacrificial layer. In alternative embodiments there can be more than one strip or a combination of strips and other openings, such as holes, in sacrificial layer 46, which, when filled as described above, result in corresponding support structures, for example, ridges or posts, respectively, that support heater layer 8 over isolating cavity 36.

The fabrication process described herein (starting with dielectric thermal barrier layer 10 including interlayer dielectric layers of CMOS circuitry fabricated on the device) is compatible with the fabrication of drive electronics and logic on the same silicon substrate as the heaters. This is a prerequisite in order to control the large number of heaters needed on a thermal inkjet printhead able to meet current and future requirements for print speed. In contrast, the heater with an underlying cavity that is described in U.S. Pat. No. 5,751,315 uses a polysilicon heater. Such a heater material requires high temperature deposition and is not compatible with CMOS fabrication requirements in which the heater is deposited subsequent to the sintering of aluminum for the CMOS circuitry, thereby constraining heater deposition temperature not to exceed 400 C.

A second prerequisite of thermal inkjet printheads able to meet current and future printing resolution requirements is that heaters for adjacent drop ejectors must be closely spaced, for example at a spacing of 600 to 1200 heaters per inch. For a center to center heater spacing of about 42 microns, corresponding to 600 heaters per inch, the heater width would be approximately 30 microns or less. For a center to center heater spacing of about 21 microns, corresponding to 1200 heaters per inch, the heater width would be approximately 15 microns or less. The fabrication processes of the present invention have been demonstrated to be capable of providing heaters having a center to center distance of about 21 microns and having a heater width of less than 15 microns. Fabrication methods described in U.S. Pat. No. 5,861,902 for forming a heater having an underlying cavity for thermal isolation have difficulty providing heaters at such close spacing. In particular for the embodiment described with reference to FIG. 7 of U.S. Pat. No. 5,861,902, the sacrificial layer (90) is not bounded laterally, as layer 46 is in the present invention (see FIG. 5). In the present invention, the etching of the sacrificial layer 46 proceeds until it is stopped by the laterally bounding dielectric protective layer 38 which provides a fixed lateral limit to the isolating cavity 36 (see FIGS. 2 and 8). By contrast, while the laterally unbounded sacrificial layer (90) of U.S. Pat. No. 5,861,902 may provide adequate manufacturing tolerances for a heater spacing of 300 per inch and a heater width of about 50 microns, it will not provide the tight tolerance on width of the isolating cavity that is required for a heater spacing of 600 or 1200 per inch and a heater width of 30 microns or less.

There are also important differences between the design of the structural supports 58 of the present invention and the design of the thermally conductive columns described with reference to FIG. 7 of U.S. Pat. No. 5,861,902. In the present invention, the supports 58 are made by providing small holes only through the sacrificial layer 46 and then filling them with the dielectric protective layer 38. In a preferred embodiment, dielectric layer 38 is about twice the thickness as sacrificial layer 46. Dielectric layer 38 provides a substantially planar base for electrically resistive heater layer 8, so that heater layer 8 is nearly planar with substantially uniform thickness, even in embodiments including supports 58. In addition the width of the supports 58 is preferably less than or equal to 1 micron, so that very little heat is transferred through the supports to the substrate. By contrast, in order to make the thermally conductive columns described with reference to FIG. 7 of U.S. Pat. No. 5,861,902, the holes are made through two layers (sacrificial silicon dioxide layer 90 and silicon nitride dielectric layer 92). The subsequently formed dielectric layer (24) is deliberately kept thin and will not be able to provide a significant amount of planarization. As a result, resistive heating element (14) of U.S. Pat. No. 5,861,902 is not nearly planar and does not have substantially uniform thickness, as a substantial portion of resistive layer (14) forms the interior of the vertical thermally conductive columns. At each column where the resistive heating element (14) gets thicker, the heater will have an undesirable cool spot. The thermally conductive columns may be appropriate in the case of the 50 micron wide heaters contemplated in U.S. Pat. No. 5,861,902 in order to remove heat from interior regions of the heater. However, it has been found for heaters narrower than about 30 microns, such thermally conductive columns are unnecessary. Supports 58 of the present invention are made small in width providing a large thermal impedance, and do not degrade the thermal efficiency of the isolated heater.

Experimentally determined advantages of the design of the present invention when compared to prior art devices having no isolating cavity underlying the heater will now be described.

Two sets of devices were fabricated, one set with the isolated heaters of the present invention and one set using non-isolated heaters of the prior art design. Both heaters used the same material and thicknesses for the insulating passivation layer 16 and protective layer 18. Both heaters were the same size. The lower dielectric layer 38 of the isolated heater of the present invention was 0.2 μm of silicon nitride and the isolating cavity was 0.1 μm high. Devices were measured in an open pool of ink, without the nozzle plate on. A 0.6 μsec heat pulse of increasing energy (voltage) was applied until bubble nucleation was observed using a strobed light and a camera for observation. For the isolated heater of the present invention the threshold energy for bubble nucleation was <70% of the threshold energy required for the non-isolated heater of the prior art design.

In the course of testing heaters for lifetime another observation was made. Isolated heaters showed a much lower degradation due to cavitation. When the nucleated bubble collapses it can damage the protective layer drilling a small hole that deepens for every bubble nucleation. Eventually such damage can make it through the protective layer exposing the heater. This shortens the lifetime of the heater. It was observed during experimental open pool testing that isolated heaters do not exhibit this defect. It is believed that in the isolated heater case when the bubble collapses the isolated heater is able to absorb some of the momentum energy by converting it to elastic membrane deformation. In contrast heaters of the prior art are not suspended and are formed on a rigid surface so that the heater layers can absorb the full shock of bubble collapse. In an actual device having a nozzle plate, how much of an impact bubble collapse has on lifetime can also be a function of the chamber geometry and whether or not the bubble is vented through the nozzle during drop ejection. Still, the elastic membrane deformation that occurs for the suspended heater of the present invention can have beneficial effects for reducing the amount of cumulative damage to the heater that otherwise could occur due to many firings of the same jet.

Figure 13A:
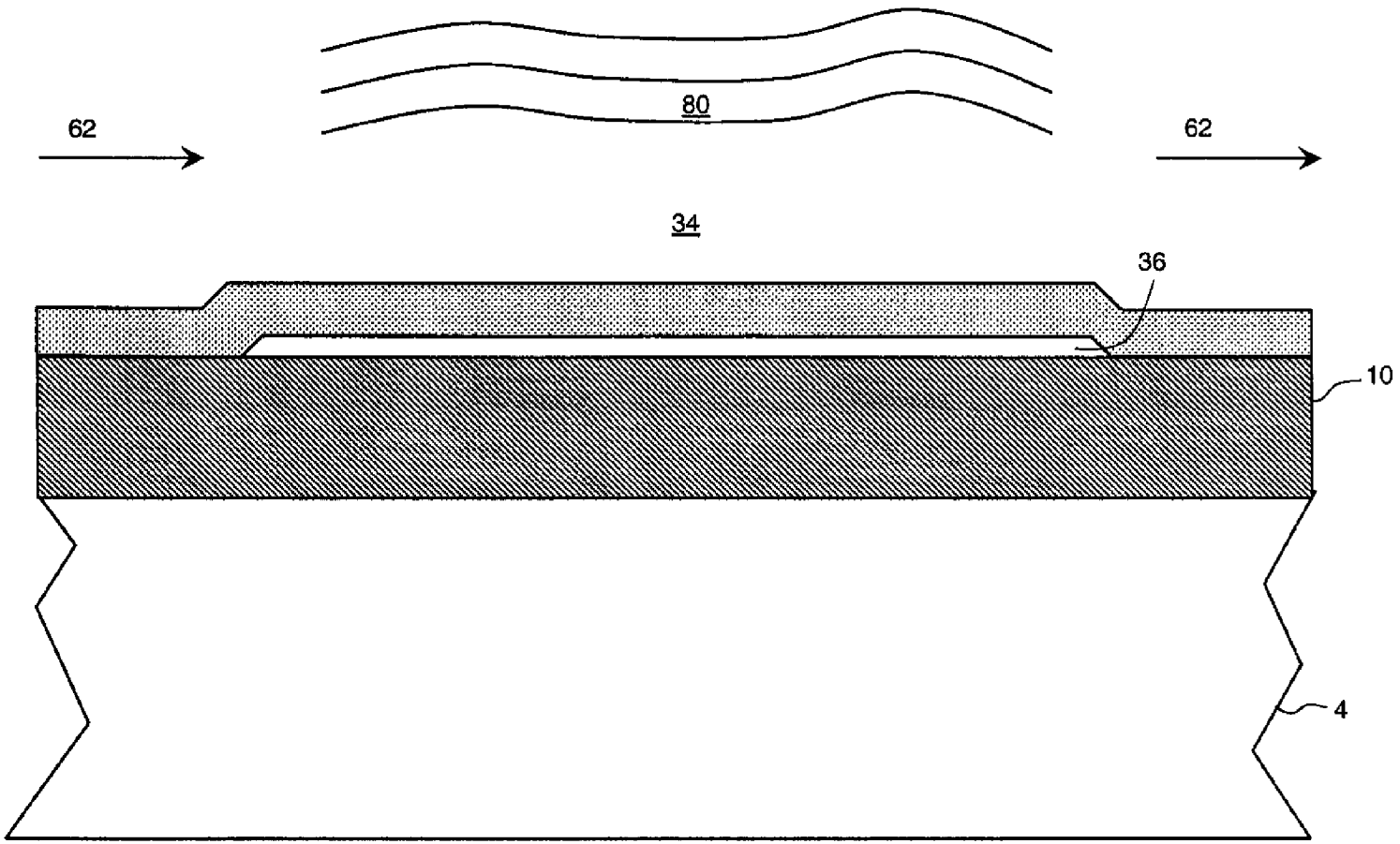
FIG. 13*a* is a schematic cross sectional drawing of one isolated heater of the present invention in an open pool of ink when a current pulse is just applied.
Figure 13B:
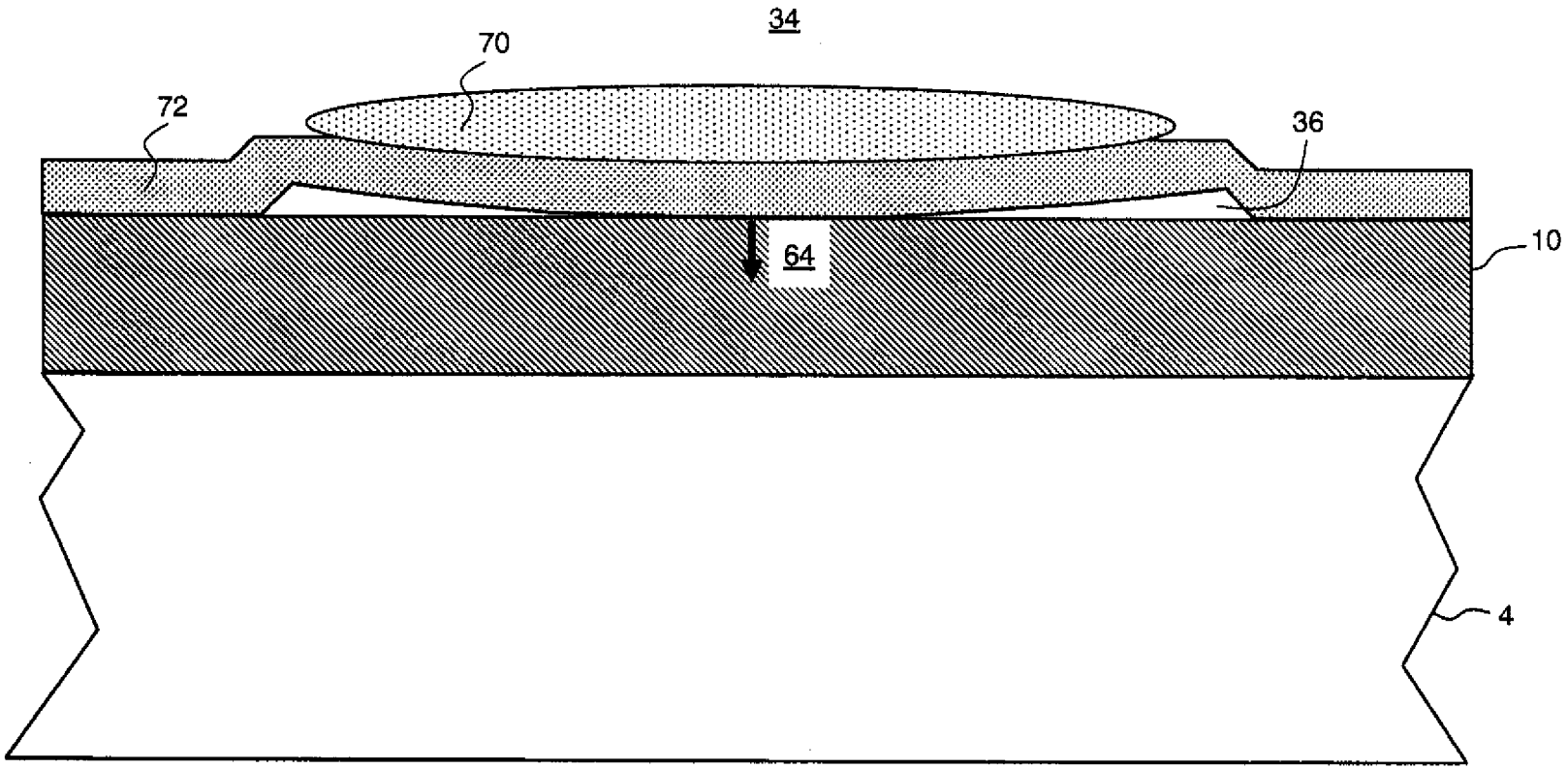
FIG. 13*b* is a schematic cross sectional drawing of one isolated heater of the present invention in an open pool of ink when a bubble has nucleated.

FIGS. 13*a*-13*d* schematically illustrates this effect using a simplified schematic cross-section of an isolated heater region 34 of the present invention where the different layers are not delineated. FIG. 13*a* shows a simplified schematic cross-section of an isolated heater of the present invention at the start of an application of a heat pulse, represented by the current arrows 62. Ink 80 lies above the isolated heater. When the temperature at the ink heater interface reaches a critical temperature (approx. 280 C) a bubble 70 will start to nucleate. At the start of nucleation of the bubble the pressure on the heater rapidly rises to approximately 70 Atmospheres and then immediately starts to drop. Modeling has shown that due to this pressure pulse the suspended heater will be pushed down to contact the lower surface 72 as shown schematically in FIG. 13*b*.

One issue to resolve when designing a suspended heater is that there are fewer paths to transfer the heat away from the heater region before the bubble collapses and fresh ink flows back over the heater. If the heater temperature is greater than approximately 100 C when fresh ink flows over the heater, then there is a possibility of boiling of the refilling ink causing drop ejection instability. While the heater is in contact with the lower surface 72, due to pressure created during bubble nucleation, some of this excess heat is removed from the heater at a point in time where it is not detrimental to the bubble formation process as illustrated by heat flow arrow 64.

Figure 13C:
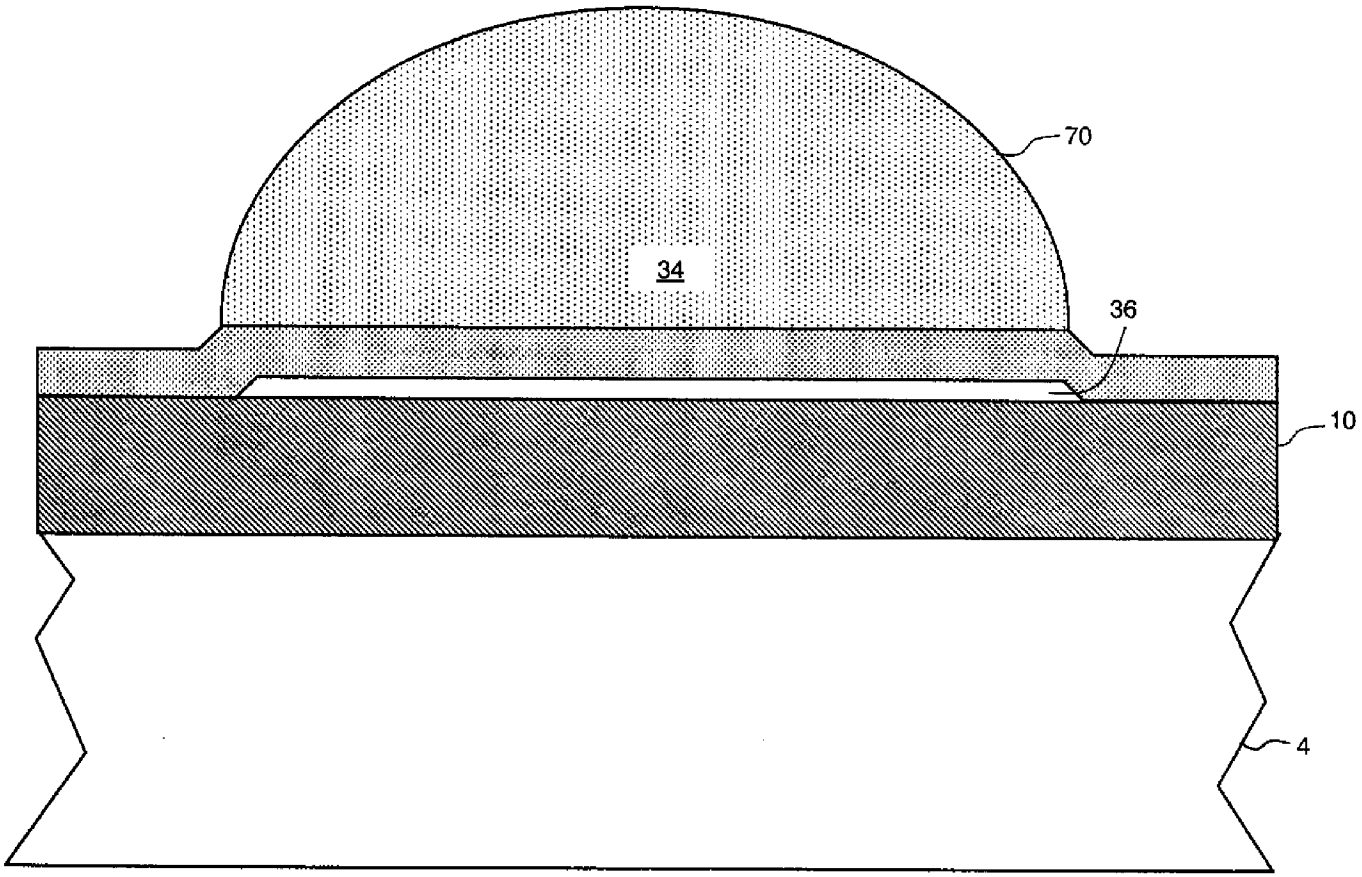
FIG. 13*c* is a schematic cross sectional drawing of one isolated heater of the present invention in an open pool of ink when a bubble has further expanded.
Figure 13D:
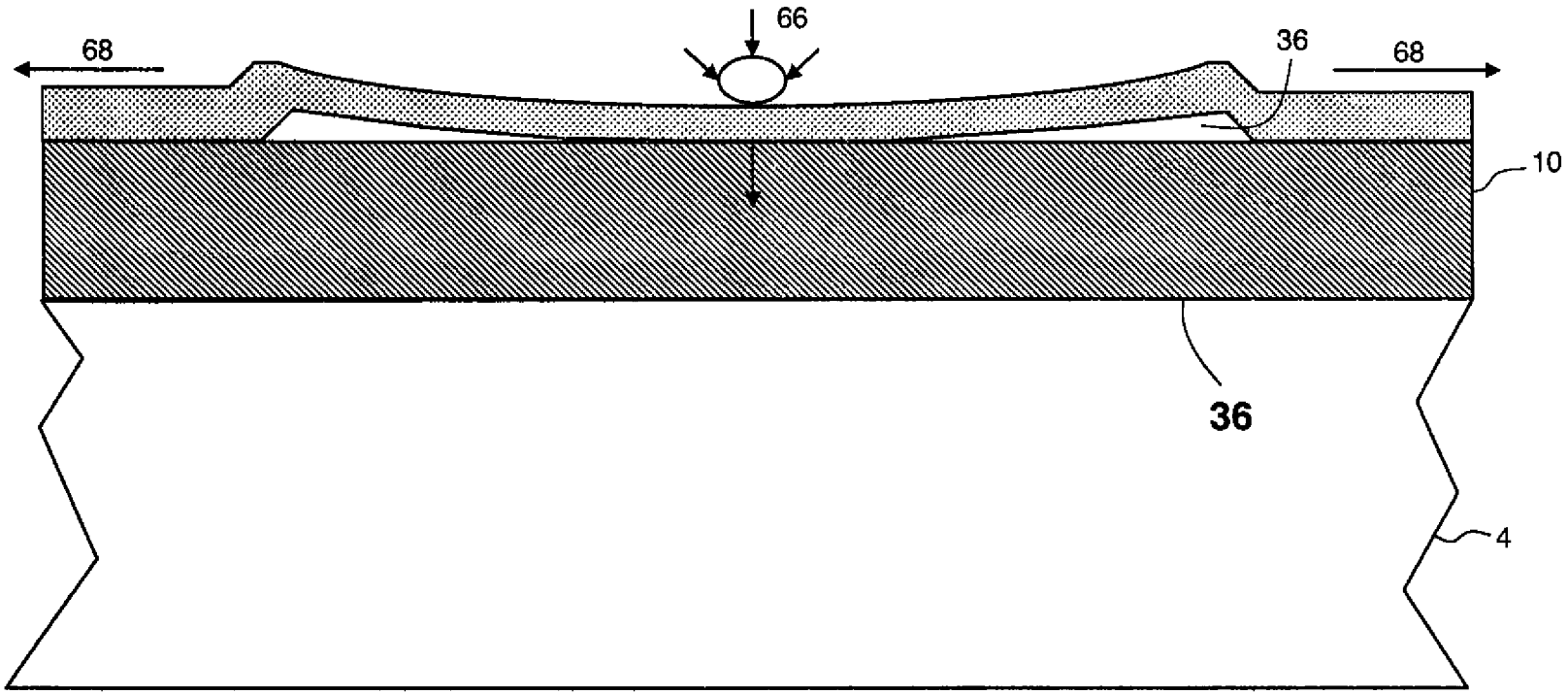
FIG. 13*d* is a schematic cross sectional drawing of one isolated heater of the present invention in an open pool of ink showing the bubble collapsing on the heater.

As the bubble expands the pressure drops, falling an order of magnitude in approximately 0.2 μsec, and the heater returns to its suspended position as shown schematically in FIG. 13*c*. After approximately 1 μsec the pressure inside the bubble has fallen below ambient pressure and the bubble begins contracting. The bubble collapses to a point with the inertia from the bubble collapse causing an impact to the heater surface at a point as shown schematically in FIG. 13*d*. At this point the suspended heater compliantly deforms from the force of the collapsing bubble impact as shown schematically in FIG. 13*d* by the directional recoil arrow 66. It is believed that this recoil minimizes the damage due to bubble collapse that is normally seen on heaters of the prior art.

Another aspect of the present invention is the heat spreading layer 55. While the nucleation and expansion of the bubble occurs in <1 μsec, the collapse of the bubble and refilling of the ink occurs on a time scales of the order of 5 μsec. The heat spreading layer 55 will carry heat away from the heater layer over this time scale and allow the ink to preferentially absorb the heat so that it can be ejected during subsequent drop ejections as depicted by heat flow arrows 68 in FIG. 13*d*. No boiling of the ink during the ink refilling process was observed during experimental testing.

Another aspect of the isolated heater region 34 of the present invention is the limited amount of thermal capacitance used in the isolated heater stack 32. The total thickness of the isolated heater stack 32 is limited to <0.6 μm. The small amount of energy storing capacity contained in the isolated heater region 34 limits the amount of thermal energy available to the returning ink, thus limiting the temperature rise of the ink, thus improving the thermal efficiency of the heater and decreasing the likelihood of unwanted bubble nucleation during refill.

The invention has been described in detail with particular reference to certain preferred embodiments thereof, but it will be understood that variations and modifications can be effected within the scope of the invention.

PARTS LIST

2 Prior art single inkjet ejector
4 Silicon substrate
6 Prior art heater stack
8 Electrically resistive heater layer
10 Dielectric thermal barrier layer
12 Electrically conductive layer
14 Heater area
16 Insulating passivation layer
18 Protection layer
20 Ink chamber
22 Nozzle plate
24 Nozzle
26 Arrows
30 Single inkjet ejector of the present invention
32 Isolated heater stack of the present invention
34 Isolated heater region of the present invention
36 Isolating cavity
38 Lower dielectric protective layer
40 Arrow
42 Lateral Arrows
44 *a,b* Metal lead
46 Sacrificial layer
48 Protrusions
50 *a,b* Vias
51 photoresist layer

52 openings
54 insulating sealing layer
55 heat spreading layer
56 holes
58 supports
60 strip along heater
62 current arrows
64 heat flow arrow
66 recoil arrow
68 heat flow arrow
80 ink

The invention claimed is:

1. A liquid ejector comprising: a substrate including a first surface; a first dielectric layer disposed on the first surface; a second dielectric layer spanning the first dielectric layer; wherein the second dielectric layer abuts the first dielectric layer at an abutting portion and is spaced apart from the first dielectric layer at a cavity portion such that a cavity is formed between the first dielectric layer and the second dielectric layer at the cavity portion, wherein the cavity is laterally bounded on two sides by the second dielectric layer and is bounded by the first dielectric layer on a side, different from the two sides, so that the first dielectric layer is between the cavity and the substrate at the cavity portion; a heating element disposed on the second dielectric layer and includes a first edge along a length between electrical contacts; an insulating sealing material that seals the cavity at a plurality of portions that project beyond the first edge of the heating element; and a chamber including a nozzle located over the heating element, the chamber being shaped to receive a liquid, the cavity being isolated from the liquid.

2. The liquid ejector of claim 1 further comprising: an electronic circuit located over the first surface of the substrate, the heating element being in electrical communication with the electronic circuit.

3. The liquid ejector of claim 1, wherein the cavity includes a cross sectional thickness less than or equal to 1000 Angstroms.

4. The liquid ejector of claim 1, wherein the heating element has a substantially uniform thickness in cross section.

5. The liquid ejector of claim 1, wherein a pressure of the cavity is less than atmospheric pressure.

6. The liquid ejector of claim 1, wherein the heating element includes a width less than or equal to 30 microns.

7. The liquid ejector of claim 1 further comprising a plurality of heating elements, wherein a center to center heating element spacing of adjacent heating elements is less than 45 microns.

8. The liquid ejector of claim 1 further comprising: a third dielectric material layer located between the heating element and the chamber.

9. The liquid ejector of claim 8 wherein a total thickness of the second dielectric layer, and the heating element is less than or equal to 5000 Angstroms.

10. The liquid ejector of claim 1, wherein the heating element and the second dielectric layer are deformable into the cavity.

11. The liquid ejector of claim 1, further comprising: a electrically conductive layer in electrical communication with the heating element, wherein the electrically conductive layer does not overlap the cavity.

12. The liquid ejector of claim 1, wherein the dielectric material layer includes a support structure that extends into the cavity.

* * * * *